US006140260A

United States Patent [19]

Johnson et al.

[11] Patent Number: 6,140,260

[45] Date of Patent: Oct. 31, 2000

[54] PAPERMAKING FELT HAVING HYDROPHOBIC LAYER

[75] Inventors: Michael Carl Johnson, Appleton; Gary Vernon Schultz, Kimberly, both of Wis.

[73] Assignee: Appleton Mills, Appleton, Wis.

[21] Appl. No.: 08/857,453

[22] Filed: May 16, 1997

[51] Int. Cl.[7] ..... B32B 5/02

[52] U.S. Cl. ..... 442/270; 139/383 A; 162/358.1; 162/900; 442/271; 442/326; 442/334; 442/337

[58] Field of Search ..... 139/383 A; 442/270, 442/271, 326, 334, 337; 162/358.1, 900

[56] References Cited

U.S. PATENT DOCUMENTS

| | | | |
|---|---|---|---|
| 3,214,327 | 10/1965 | Wicker et al. | 162/205 |
| 3,214,331 | 10/1965 | Wicker | 162/358 |
| 3,556,940 | 1/1971 | Cronin | 162/358 |
| 4,162,190 | 7/1979 | Ashworth | 162/359 |
| 4,199,401 | 4/1980 | Liu et al. | 162/358 |
| 4,988,409 | 1/1991 | Nyberg | 162/358 |
| 5,182,164 | 1/1993 | Eklund et al. | 428/234 |
| 5,372,876 | 12/1994 | Johnson et al. | 428/233 |

*Primary Examiner*—James J. Bell
*Attorney, Agent, or Firm*—Thomas D. Wilhelm

[57] ABSTRACT

A felt for use in a papermaking machine includes a woven base fabric and a batt layer for supporting the paper web. A flow control layer is interposed between the base fabric and the fibrous batt layer, to impede rewetting of the paper web as the paper web exits a press nip of the papermaking machine. The flow control layer is formed of a porous hydrophobic material. Pressure exerted by the press nip forces water from the paper web through the batt layer and the flow control layer into the base fabric. When the pressure is relieved, the hydrophobic properties of the flow control layer impede back-flow of water to the batt layer and thence to the paper web, thereby impeding rewetting of the web. The flow control layer is preferably formed of a spunbonded filamentary nylon material which is non-circular in cross-section, such as tri-lobed/triangular, and which may be treated with an hydrophobic chemical composition to enhance hydrophobic properties. The batt layer and the base layer are preferably secured into the felt by a needling process.

49 Claims, 5 Drawing Sheets

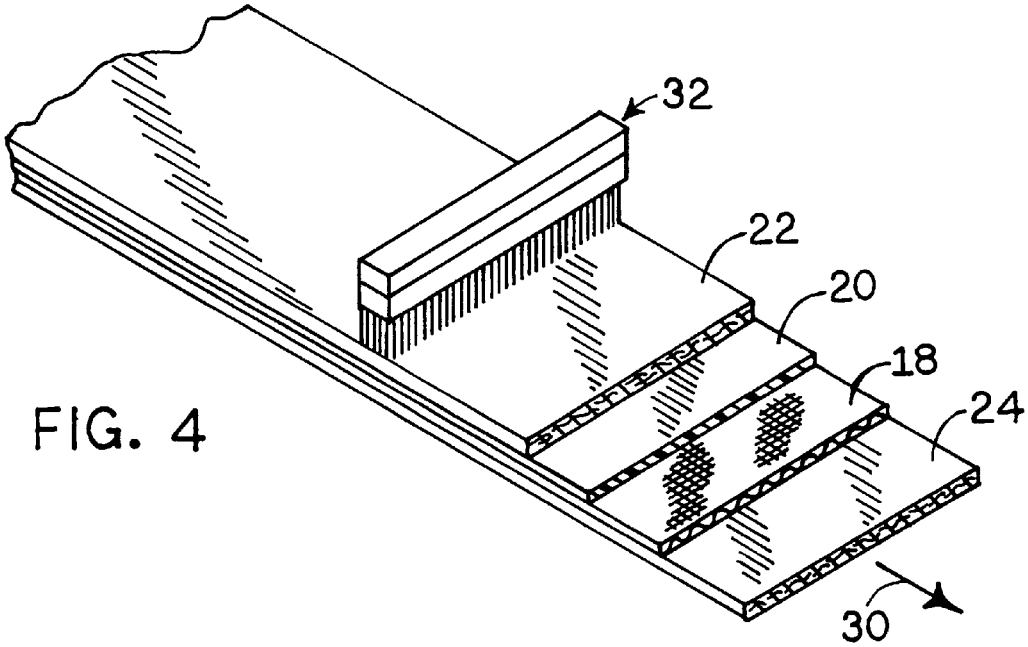
FIG. 4
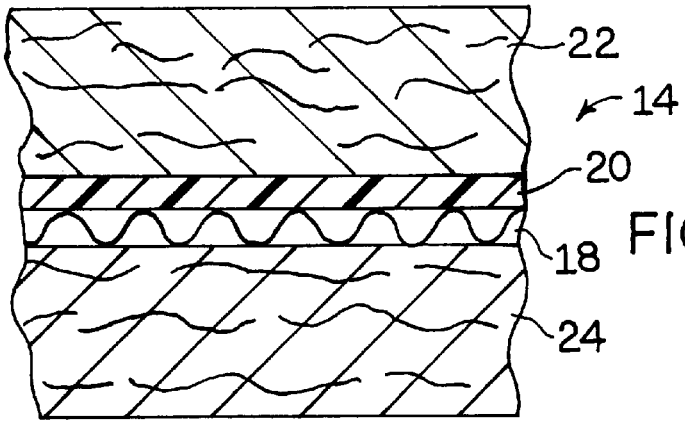
FIG. 2
FIG. 3
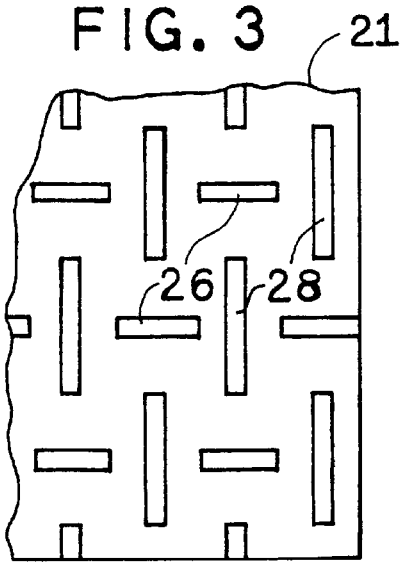
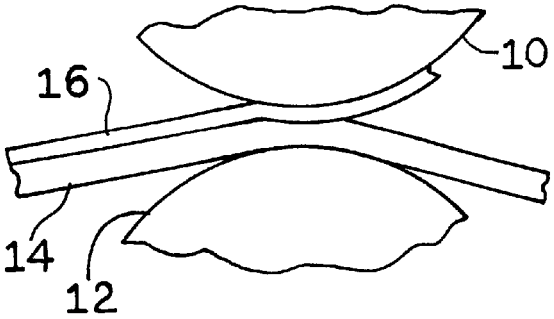
FIG. 1

PAPERMAKING FELT HAVING HYDROPHOBIC LAYER

CROSS REFERENCE TO RELATED APPLICATIONS

Not Applicable

STATEMENT REGARDING FEDERALLY SPONSORED RESEARCH OR DEVELOPMENT

Not Applicable

BACKGROUND

This invention relates to a felt construction for use in a papermaking machine, and more particularly to a felt construction which functions to control rewetting of the paper web upon exit of the web from a press nip of the papermaking machine.

Rewetting of a paper web as the paper web exits the press nip of the papermaking machine is a recognized problem in the papermaking industry. Various patents address this problem, including U.S. Pat. No. 3,214,327 Wicker et al; U.S. Pat. No. 3,214,331 Wicker; U.S. Pat. No. 3,556,940 Cronin; U.S. Pat. No. 4,162,190 Ashworth; U.S. Pat. No. 4,199,401 Liu et al; U.S. Pat. No. 4,988,409 Nyberg; and U.S. Pat. No. 5,182,164 Ecklund et al; as well as U.S. Pat. No. 5,372,876 issued to the inventors herein.

It is an object of the present invention to provide an improved papermaking felt capable of efficiently and effectively removing water from the paper web at the press nip and efficiently and effectively impeding backflow of water through the felt as pressure imposed on the felt by the press nip is released.

It is another object of the invention to provide an improved papermaking felt which is relatively simple in construction yet which performs in a highly satisfactory manner to facilitate removing water from the web and to impede rewetting of the web.

It is a further object to provide an improved papermaking felt having at least one layer comprising non-circular filaments therein, the non-circular filaments facilitating achievement of the desired removal of water from the paper web.

It is a more specific object to provide an improved papermaking felt having at least one layer comprising at least 10% by weight non-circular filaments therein, the non-circular filaments facilitating achievement of the desired removal of water from the paper web.

It is a yet further object to provide an improved papermaking felt having at least one layer comprising at least 10% tri-lobed filaments therein, the tri-lobed filaments facilitating achievement of the desired removal of water from the paper web.

SUMMARY

Some of the objects are obtained in a first family of embodiments comprising a felt for use in dewatering fibrous material such as to make a web of paper in a papermaking machine. The felt comprises a fibrous batt layer having opposing first and second surfaces on respective first and second sides thereof, the first surface being disposed toward the web of paper. A porous hydrophobic flow control layer of filaments is disposed on the second side of the fibrous batt layer, at least 10 percent by weight of the filaments in the flow control layer being non-circular filaments and thus, in cross-section, representing substantially non-circular perimeters. The fibrous batt layer and the flow control layer are joined into the felt such that water under pressure from a press nip in e.g. the papermaking machine is forced from the fibrous batt layer and through the flow control layer, and wherein the flow control layer functions to impede backflow of water into the fibrous batt layer as pressure, of the press, on the felt is relieved.

Others of the objects are obtained in a second family of embodiments comprehending a felt which comprises a fibrous batt layer having opposing first and second surfaces on respective first and second sides of the fibrous batt layer, the first surface being disposed toward the fibrous material. A base fabric has a third surface disposed toward the fibrous batt layer, and an opposing second surface. First and second porous hydrophobic flow control layers of synthetic filaments are disposed between the fibrous batt layer and the base fabric. The fibrous batt layer, the base fabric, and the first and second flow control layers are joined together in the felt. Water under pressure from a press nip in the papermaking machine is forced from the fibrous batt layer, including through the first and second flow control layers. The first and second flow control layers function to impede backflow of water into the fibrous batt layer as nip pressure on the felt is relieved by passage of the felt through and out of the nip.

Still others of the objects are obtained in a third family of embodiments comprehending a felt which comprises the same fibrous batt layer having opposing first and second surfaces on respective first and second sides of the fibrous batt layer, the first surface being disposed toward the fibrous material. A base fabric has a third surface on a third side thereof, disposed toward the fibrous batt layer, and a fourth opposing surface disposed away from the fibrous batt layer. The base fabric is between the fibrous batt layer and a flow control layer. In these embodiments, the felt is devoid of layers corresponding to the flow control layer between the base fabric and the fibrous batt layer.

In preferred flow control layers of the invention, at least 30%, preferably at least 50%, more preferably at least 75%, most preferably at least 90% by weight, of the filaments in the respective flow control layer are non-circular filaments, for example tri-lobed filaments or four-lobed filaments.

BRIEF DESCRIPTION OF THE DRAWINGS

FIG. 1 shows a partial sectional view of a conventional press nip of a papermaking machine in which the felt of the present invention is employed.

FIG. 2 shows an enlarged cross-section view of structure of a papermaking felt of the invention incorporating therein a flow control layer.

FIG. 3 shows a partial plan view of material used to make the flow control layer of the felt of FIG. 2.

FIG. 4 shows a partial pictorial representation illustrating some of the steps used in manufacturing felts of the invention.

Figure 5:
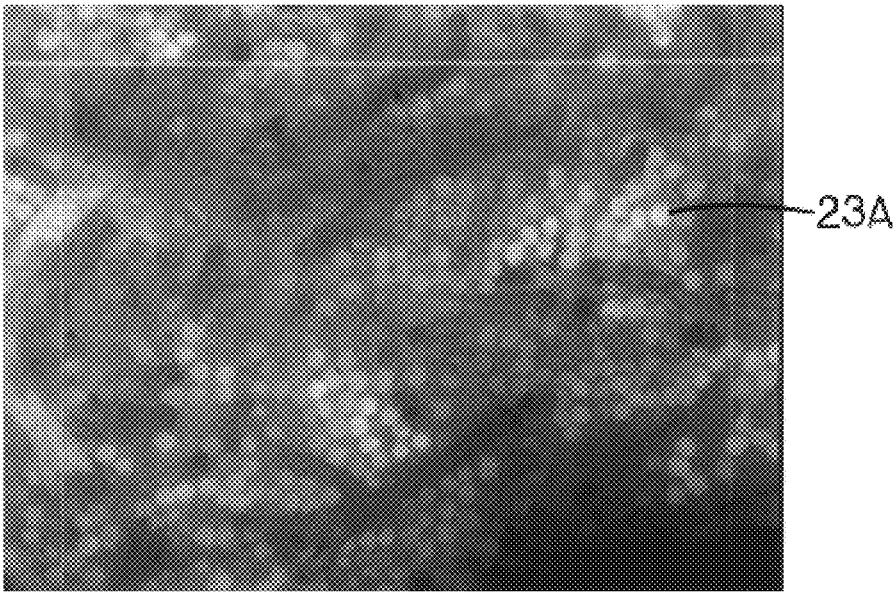
FIG. 5 is an enlarged photograph showing cross-sections of filaments of a first web material useful in making a flow control layer of the invention, the photograph including discernible circular cross-section configurations of the filaments.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring now by characters of reference to the drawings, and first to FIG. 1, a press nip of a papermaking machine generally includes a pair of spaced press rolls 10, 12 defining the nip therebetween. A papermaking felt 14 supports a paper web 16, as felt 14 and 16 travel in a left-to-right direction through the nip defined between rolls 10, 12. From the nip, the paper web 16 is separated from the felt, and moves thence toward the dryer section of the papermaking machine. The water expressed from paper web 16 at the nip defined between rolls 10, 12 generally passes through felt 14 and may at least in part be transferred to the surface of roll 12. The water is subsequently removed from the surface of roll 12 by a wiper, a doctor blade, or other dewatering apparatus (not shown). Further treatment of the felt removes water from the felt downstream of the nip.

FIG. 2 illustrates the construction of one embodiment of felt 14. Generally, felt 14 includes a base fabric 18, a flow control layer 20, an upper batt layer 22, and a lower batt layer 24.

Base fabric 18 is a conventional endless layer of interwoven warp and weft yarns. Base fabric 18 may or may not have a transverse seam, as desired for a particular implementation. The material from which the yarns of base layer 18 is made can be, for example, wool, synthetic, or a blend of wool and synthetic yarns. In any event, base layer 18 is constructed of tough and strong yarns in both the warp and weft directions, and may have any desired weave pattern.

Flow control layer 20 is made from a sheet of synthetic nonwoven filamentary material, such as a spunbonded sheet 21 of nylon 6,6 filaments, such as is conventionally available from suppliers of sheets 21 of such fabrics. The material of sheet 21 comprises individual filaments of nylon spunbonded together to thereby form the sheet, in accord with conventional technology. The material of sheet 21 has a porosity in the range of 20 to 800 cfm at 0.5 inches water in the Frazier air permeability test. Preferred porosity of sheet 21 is approximately 450 cfm at 0.5 inches water.

The spunbonded nylon filaments from which sheet 21 is formed have a fineness of about 3 denier to about 6 denier, preferably about 3 denier to about 5 denier, more preferably about 3.3 denier, and are oriented in a random direction relative to the direction of travel of felt 14 through the papermaking machine.

Materials other than nylon can be used for sheet 21. Such materials include (e.g. spunbonded) sheets made from a variety of materials including siliconized nylon, polyethylene, polyester, polypropylene, rayon, or the like. Siliconized nylon is available as Grilon MC-1 from EMS-AMERICAN GRILON INC., Sumter, S.C.

In consolidating filaments in manufacture of sheet 21, the filaments may be conjoined in any satisfactory manner such as, in addition to spunbonding, hydroentangling, melt blowing, air laying, thermal or sonic bonding, chemical bonding, or the like.

Sheet 21 of spunbonded nylon material from which flow control layer 20 is constructed is preferably treated with a hydrophobic chemical composition, to render the flow control layer more hydrophobic. Preferably, the sheet of material is treated with a cationic fluorochemical, for example in a paraffin wax emulsion, in a conventional manner, to provide hydrophobicity to the material of flow control layer 20. Suitable such treatment for a spunbonded sheet is available under the trade name "Synpel" from Synthetics Finishing, Long View, N.C.

While the above chemical treatment has been found satisfactory, other hydrophobic materials could be used for treatment of sheet 21, such as a sheet in which the material from which the filaments are made is hydrophobic by nature without the need for chemical treatment. Alternatively, other suitable chemical compositions could be used to provide the required hydrophobicity to the material of sheet 21 or flow control layer 20.

Referring to FIG. 3, sheet 21 has a pattern of embossed areas shown at 26, 28. Individual filaments of the material of sheet 21 are bonded together at embossed areas 26, 28. The areas of flow control layer 20 between the embossed areas 26, 28 are more porous than the embossed areas as set forth above. The pattern of embossed areas 26, 28 renders the material of flow control layer 20 easier to work with in construction of felt 14 than a similarly constructed sheet of material but not having the embossed areas.

Embossed areas 26, 28 function to hold the filaments of flow control layer 20 together thus to consolidate and unify the sheet. The pattern of embossed areas 26, 28 is in no particular orientation relative to the direction of travel of felt 14 during operation of the papermaking machine. Neither is the particular emboss pattern itself of any particular significance so long as the emboss pattern suitably maintains unity and stability of sheet 21 while the sheet is being incorporated into the felt.

Upper batt layer 22 is a conventional fibrous batt made primarily of synthetic fibers blended together and carded to produce a web. The fibers of batt layer 22 may be any material conventionally used for constructing such an upper batt layer, for example, polyamide fibers, aromatic polyamide fibers, polyester fibers, polyacrylic fibers, polyolefin fibers, or the like. Such fibers may, for example, be used in combination with a small amount of natural fibers such as wool or regenerated fibers.

Lower batt layer 24 can be made of batt material substantially similar or identical to that of upper batt layer 22, or of any other batt material suitable for use in a papermaking felt.

FIG. 4 illustrates the manner in which felt 14 of FIG. 2 may be constructed. The individual layers of felt 14 are placed in the relative order illustrated in FIGS. 2 and 4, e.g. with base fabric layer 18 placed over lower batt layer 24, sheet 21 (to become flow control layer 20) over base fabric layer 18, and upper batt layer 22 over flow control layer 20. The layers are thus, in combination, advanced in the direction of arrow 30 (FIG. 4) and are subjected to a conventional needling operation carried out by needling head 32 needling the combined layers by driving needles into the layer combination from the batt layer 22 side of the layer combination. One or more additional needling operations may be effected, from either the layer 22 side or the layer 24 side of the layer combination, in order to further consolidate the layer combination in making a papermaking felt therefrom.

The above needling operations function to secure batt layers 22 and 24 to base fabric 18 by thus forcing the fibers of batt layers 22, 24 into and through the fabric of base layer 18, in a conventional manner. Any conventional number of needling operations may be used, as desired, generally both from top and bottom sides of the web structure.

In addition to the securement function, the needling operations function to force fibers of batt layers 22 and 24 through flow control layer 20 and through base fabric 18. While choosing to not be bound by theory, applicants contemplate that, since flow control layer 20 is formed of a filamentary spunbonded material, the needling operation functions in a manner similar to that in which fabric is sewn, thus generally forcing the fibers of batt layer 22 through pores of flow control layer 20 rather than severing, dismembering, or otherwise damaging the filaments from which the flow control layer is made.

Thus, it is believed that the needling generally does not sever, dismember, or otherwise grossly damage the structure of the bulk of the filaments of flow control layer 20. That is, the filaments of flow control layer 20 remain substantially intact after completion of the needling operation or operations. Flow control layer 20 thus maintains its integrity, and is fixed in position between upper batt layer 22 and base fabric 18. In this manner, flow control layer 20 is generally continuous through out the length and width of felt 14.

Preferably, a needling operation carried out by the one or more needling heads 32 provides needling penetrations in the range of about 1000 to about 3000 needle penetrations per square inch, preferably approximately 2000 needle penetrations per square inch.

In operation, felt 14 functions as follows. At the nip of press rolls 10, 12, felt 14 and web 16 are subjected to pressure of up to about 2000 psi, which functions to squeeze water out of web 16 and into felt 14. Water squeezed out of web 16 first passes into upper batt layer 22. The pressure exerted by rolls 10, 12, compresses substantially all the void volume out of upper batt layer 22, and thus forces such water from batt layer 22 through the pores of flow control layer 20, and correspondingly into base fabric layer 18 and lower batt layer 24.

As a particular length of felt 14 and web 16 exit the nip of press rolls 10, 12, pressure on the web and on the felt is relieved. As the pressure is relieved, water in felt 14 has a tendency to be drawn back toward web 16 by the power of atmospheric pressure exerted from outside the felt as the felt and web expand together. However, flow control layer 20, being hydrophobic, functions to impede, and generally to prevent, backflow of water from base fabric layer 18 and lower batt layer 24, to upper batt layer 22. The corresponding reduction in the amount of water flowing back into upper batt layer 22, thus reduces the amount of water flowing from upper batt layer 22 into web 16 and thus rewetting web 16. Flow control layer 20 thus essentially acts as a one-way valve, permitting one-way flow of water from upper batt layer 22 through flow control layer 20 and into base fabric layer 18 under pressure exerted by press rolls 10, 12, and impeding or preventing backflow of water in the reverse direction when pressure from press rolls 10, 12 is relieved.

While flow control layer 20 is shown and described in FIG. 2 as being positioned between upper batt layer 22 and base fabric layer 18, flow control layer 20 can be located at other positions within a multiple layer felt structure and can thus provide satisfactory performance in impeding rewetting of the paper web.

Figure 6:
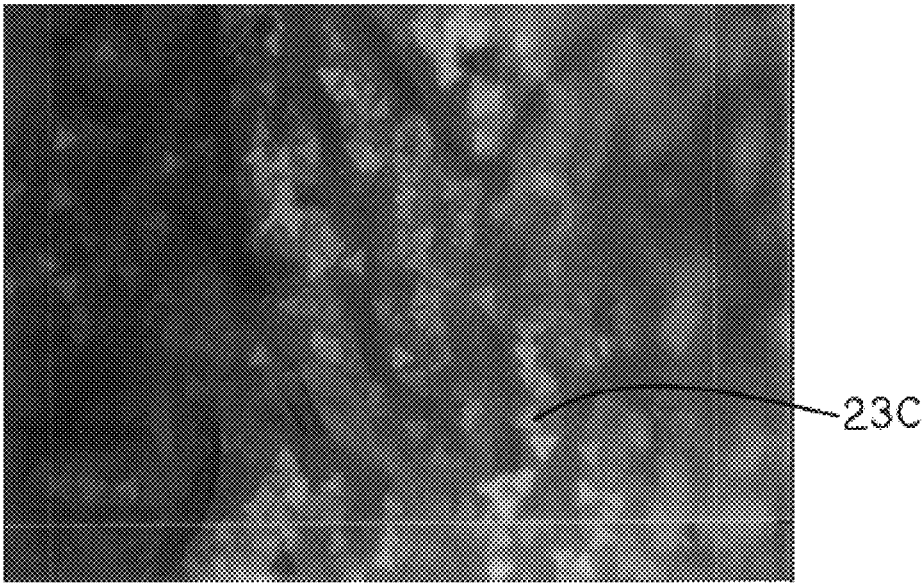
FIG. 6 is an enlarged photograph showing cross-sections of filament of a second web material useful in making a flow control layer of the invention, the photograph including discernible tri-lobed cross-section configurations of the filaments.

FIGS. 5 and 6 are photographs showing enlarged cross-sections of filaments used in constructing sheet 21, and thus flow control layer 20. FIG. 5 illustrates an embodiment wherein filaments 23A in general have substantially circular cross-sections.

FIG. 6, by contrast, shows an alternate embodiment wherein filaments 23B in general have non-circular cross-sections, namely tri-lobed cross-sections generally corresponding to equilateral triangles.

Addressing FIGS. 5 and 6 in combination, assuming equilateral triangle filament cross-sections in FIG. 6, an equivalent cross-sectional area of triangular configuration (FIG. 6) provides about 40 percent more filament surface area about the perimeter of the filament than circular filaments 23A as illustrated in FIG. 5. While not wishing to be bound by theory, applicants contemplate that the ability of flow control layer 20 to impede back flow of water is related to the hydrophobic nature of the above-described chemical treatment. The ability of the flow control layer to impede backflow of water may also be related to inherent properties of the (e.g. nylon 6,6) material of which the filaments are comprised; and may further be related to the shapes of the cross-sections of the filaments.

In general, and still without being bound by theory, applicants contemplate that even though flow control layer 20 is porous, the layer generally resists flow of water therethrough at low pressure gradient. Since sheet 21 is generally porous, and in view of the fact that sheet 21 does not readily absorb water or transport water therethrough, namely there is no mechanical impedance to water flow, it is believed that the primary resistance to flow of water is chemical in nature namely the hydrophobic repulsion of water attendant the combination of the nylon 6,6 and the fluorochemical treatment in the flow control layer. Such resistance to flow, whether mechanical or chemical, can typically be overcome by high levels of hydraulic pressure such as in the nip defined by rolls 10, 12. Accordingly, the hydraulic pressure normally present at the nip readily drives water from paper web 16 and upper batt layer 22 through flow control layer 20, into base fabric 18 and lower batt layer 24, and onto the surface of roll 12.

When the nip pressure is relieved, and the respective layers 18, 22, and 24 thus expand, void spaces are recreated upon such expansion. Ambient air pressure provides a low level (e.g. no more than atmospheric) driving force urging air and/or water into the so-recreated void spaces. Applicants contemplate that, while the resistance to water flow attendant flow control layer 20 is inadequate to prevent water from flowing through flow control layer 20 under the high hydraulic pressure at the nip, such resistance is adequate to prevent water from flowing through the flow control layer at the generally lower pressure attendant expansion of felt 14 as the felt passes out of the nip.

To the extent the impedance to water flow through the flow control layer is driven by the hydrophobic nature of the outer surfaces of the filaments, the greater the area of the outer surfaces of the filaments, in combination, the greater the potential intensity of the impedance. In that context, under some conditions, sheets 21 made with tri-lobed filaments 23B as in FIG. 6 should provide greater impedance to water flow through the flow control layer as the pressure is relieved from the nip than do sheets 21 made with generally circular filaments 23A, such that higher solids may be obtained in paper web 16 coming out of the nip.

EXAMPLE 1

A felt was made having a first structure corresponding to the structure of FIG. 2. A sheet 21 of spunbonded nylon 6,6, 1.5 ounces per square yard, filament size 4.5 denier to 5 denier, and having tri-lobed filament cross-sections as in FIG. 6, was mounted to a base fabric, as a flow control layer. Batt layers 22 and 24 of nylon were needled on either side of the base fabric and the flow control layer to make the felt. In the process, needling operations were carried out using needling heads 32 on both the layer 22 side of the layer combination and on the layer 24 side of the layer combination.

EXAMPLE 2

A felt was made as in EXAMPLE 1 except that the filaments in sheet 21 had circular cross-sections as in filaments 23A.

The felts of EXAMPLES 1 and 2 were separately mounted in a press section of a pilot scale papermaking machine, and used to press water from the fibrous web arriving at the press section nip. (Paper) web material coming into the press was approximately 20 weight percent solids. Table 1 shows the fiber solids out, namely the fiber solids in the paper web as the web left the press.

TABLE 1

| | Filament | Loading | |
|---|---|---|---|
| Ex. No. | Type | 100 pli | 200 pli |
| 1 | Tri-lobe | 38.7% | 41.4% |
| 2 | Circular | 37.7% | 40.4% |

In view of the above favorable results for tri-lobed filaments, when compared against circular filaments, applicants anticipate similar favorable results with four-lobed filaments, and possibly with five-lobed filaments.

In Table 1, differences of at least 0.5% are meaningful in that they represent real differences of performance. Thus, Table 1 illustrates that a felt incorporating therein a flow control layer having the tri-lobed filaments can provide superior performance over the same felt having a flow control layer but using circular filaments.

EXAMPLES 3–8

Felts of Examples 3–8 were made having second (Examples 3–5) and third (Examples 6–8) structures corresponding generally to the structure of FIG. 2 but including different structures within corresponding ones of the individual layers. Thus, EXAMPLES 3–8 illustrate two different felt structures, each having an upper batt layer, a lower batt layer, and a base fabric, and using a single flow control layer having circular filaments, a single flow control layer having tri-lobed filaments, or, in the case of a control felt, having no flow control layer. As in EXAMPLES 1 and 2, the felts of EXAMPLES 3–8 were separately mounted in a press section of a pilot scale papermaking machine, and used to press water from a fibrous web arriving at the press section nip. Examples 3 and 6 were control. Examples 4 and 7 incorporated flow control layers having circular cross-section filaments 1.5 ounces per square yard. Examples 5 and 8 incorporated flow control layers having tri-lobed cross-section filaments 1.5 ounces per square yard.

Table 2 shows the fiber solids out, namely the fiber solids in the paper web as the web left the press. Caliper is mils after 2 hours break-in. Felt weight is ounces per square foot. Permeability is cfm according to ASTM D737. Press solids is percent by weight solids into and out of the press nip. While not specifically stated in Table 2, press solids into the press was about 20% by weight for Examples 6–8.

TABLE 2

| Ex. | FC Layer | Felt | 2 Hr | Permeability | | Press Solids | |
|---|---|---|---|---|---|---|---|
| No. | Type | Weight | Caliper | Initial | 2 hrs. | In | Out |
| 3 | None | 4.09 | 82 | 35 | 10 | 20.0% | 42.4% |
| 4 | Circ | 4.42 | 86 | 27 | 7 | 19.8% | 43.2% |
| 5 | Tri-Lob | 4.26 | 88 | 31 | 9 | 20.5% | 43.1% |
| 6 | None | 3.97 | 88 | 88 | 28 | | 40.4% |
| 7 | Circ | 4.21 | 93 | 58 | 19 | | 41.0% |
| 8 | Tri-Lob | 4.28 | 96 | 58 | 20 | | 40.9% |

All paper webs in the above examples had basis weights at ambient conditions of about 50 grams per square meter.

A comparison of Tables 1 and 2 illustrates that the benefits of the non-circular layers apply to some, though not all, papermaking design environments.

The non-circular filaments need not, of course, be symmetrical, nor need they have necessarily straight sides as predominate in FIG. 6. Rather, any cross-section geometry that increases the surface area of the filament is an improvement over the circular cross-section, and may thereby find advantage over circular filaments under certain use conditions.

Figure 7:
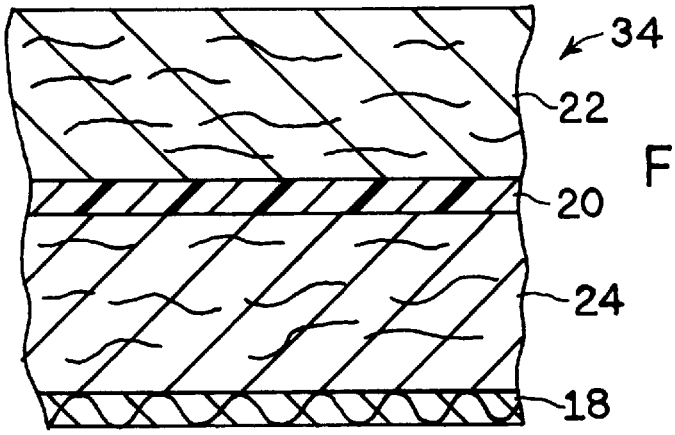
FIG. 7 shows a cross-section similar to that of FIG. 2 illustrating a second structure for papermaking felts of the invention.

FIG. 7 illustrates a papermaking felt 34, also constructed according to the invention. Like reference characters are used to facilitate clarity. In felt 34, upper batt layer 22 and flow control layer 20 are in the same positions as in felt 14 of FIG. 2. However, in felt 34, the positions of base layer 18 and lower batt layer 24 are reversed, such that lower batt layer 24 is between base fabric 18 and flow control layer 20. In this structure, flow control layer 20 functions in essentially the same manner as in felt 14 to impede or prevent backflow of water from lower batt layer 24 to upper batt layer 22 when pressure on felt 34, at the press nip, is removed.

Figure 8:
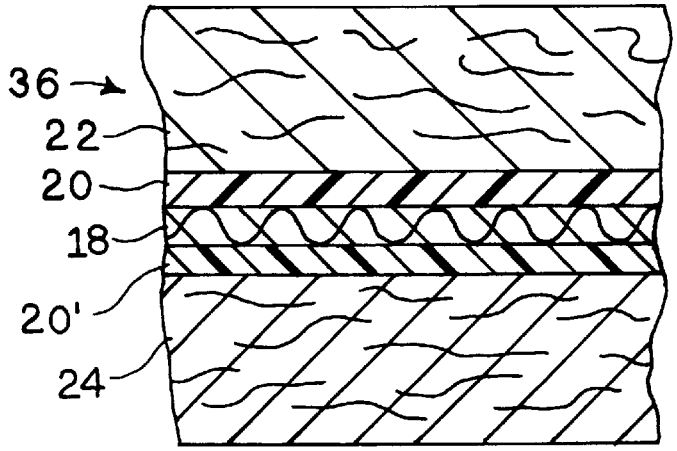
FIG. 8 shows a cross-section similar to that of FIGS. 2 and 7, illustrating a third structure for papermaking felts of the invention.

FIG. 8 illustrates a felt 36 constructed according to the invention. Like reference characters are used to facilitate clarity. Felt 36 includes upper batt layer 22, flow control layer 20, base fabric 18, and lower batt layer 24. Felt 36 further incorporates a second flow control layer 201, interposed between lower batt layer 24 and base fabric 18. Flow control layer 20' functions to impede or prevent backflow of water from lower batt layer 24 to base fabric 18, and flow control layer 20 functions the same as in felt 14 to impede or prevent backflow of water from base fabric 18 to upper batt layer 22. Flow control layer 20 also serves to impede back flow of water moving from layers 24 or 20. Flow control layer 20' essentially serves as a backup (back flow) flow control valve to relieve pressure on flow control layer 20 which otherwise may be exerted if large quantities of water were present in lower batt layer 24. Second flow control layer 20' may have composition and structure identical to that in first flow control layer 20. Alternatively, second flow control layer 20' may have different composition and/or structure. Variables may be, for example, filament cross-section, chemical treatment, basis weight, forming method, and the like.

Figure 9:
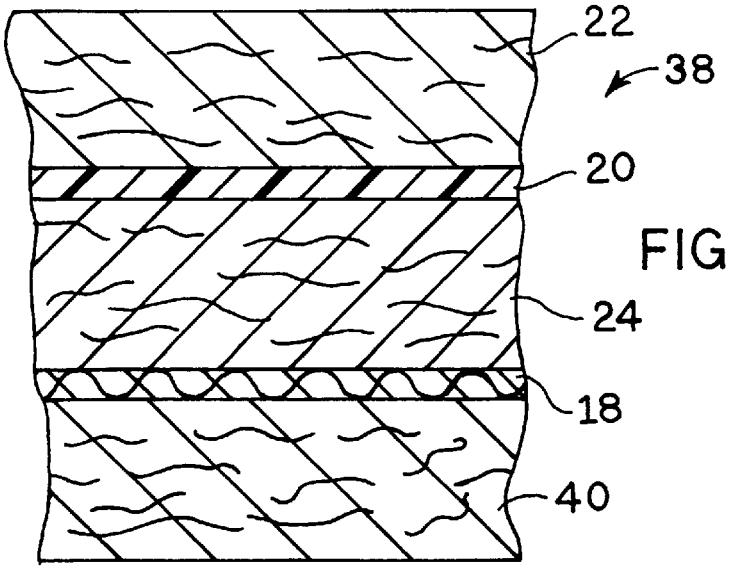
FIG. 9 shows a cross-section similar to that of FIGS. 2, 7, and 8, illustrating a fourth structure for papermaking felts of the invention.

FIG. 9 illustrates a felt 38 constructed according to the invention. Like reference characters are used to facilitate clarity. Felt 38 includes upper batt layer 22, flow control layer 20, lower batt layer 24 and base fabric 18. These layers are in the same position as in felt 34 of FIG. 7. Felt 38 further incorporates an additional batt layer 40 needled to base fabric 18 and typically to ones of the remaining layers of felt 38. Batt layer 40 functions in a similar manner to layer 24 (FIGS. 2, 8) to facilitate flow of water from base fabric 18 to nip roll 12. Flow control layer 20 functions in a manner similar to layer 20 in felts 14, 34, 36 to prevent backflow of water from lower batt layer 24 to upper batt layer 22 when pressure on felt 38 is relieved.

Figure 10:
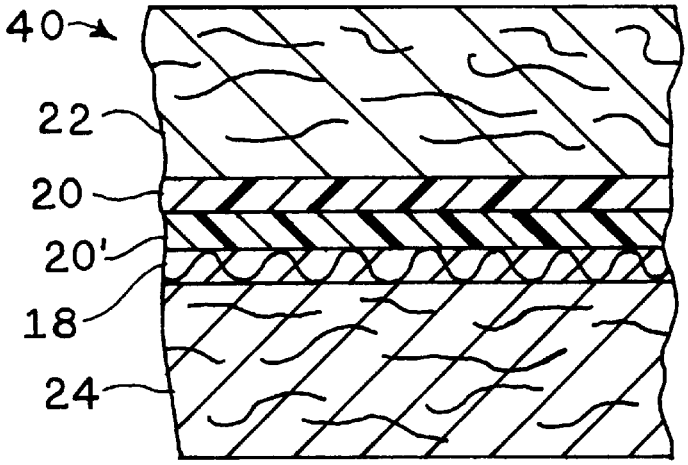
FIG. 10 shows a cross-section similar to that of FIG. 8, illustrating a fifth structure for papermaking felts of the invention wherein two flow control layers are disposed between the base fabric and the outer batt layer.

FIG. 10 illustrates a felt 40 constructed according to the invention. Like reference characters are used to facilitate clarity. Felt 40 includes upper batt layer 22, lower batt layer 24 and base fabric 18. Flow control layer 20 is located between upper batt layer 22 and base fabric 18. These layers are in the same position as in felt 14 of FIG. 2. Felt 40 further incorporates second flow control layer 20' between flow control layer 20 and base fabric 18. The second flow control layer 20' essentially serves as a backup flow control valve to relieve pressure on flow control layer 20 which otherwise may be exerted if large quantities of water are present in lower batt layer 24 or base fabric. Flow control layers 20 and 20' may differ from each other as discussed with respect to FIG. 8.

Figure 11:
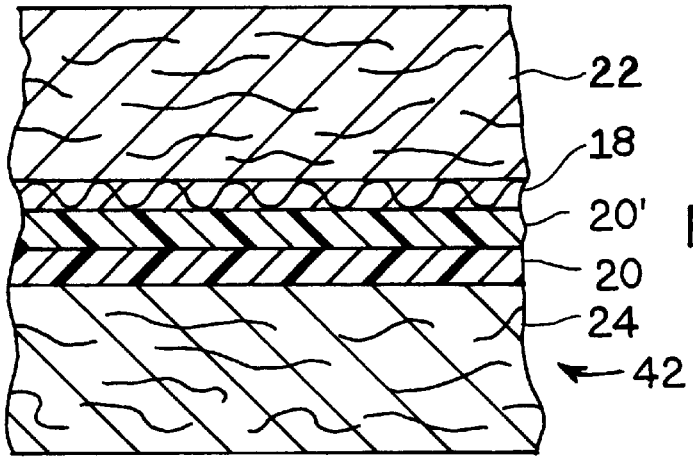
FIG. 11 shows a cross-section similar to that of FIG. 8, illustrating a sixth structure for papermaking felts of the invention wherein the base fabric is disposed between the outer batt layer and two flow control layers.

FIG. 11 illustrates a felt 42 constructed according to the invention. Like reference characters are used to facilitate clarity. Felt 42 includes upper batt layer 22, first and second flow control layers 20 and 20', lower batt layer 24, and base fabric 18. These layers, themselves, may generally be the same as respective layers in felt 40 of FIG. 10. However, in felt 42, base fabric 18 is located between the flow control layers and upper batt layer 22, thus to give more direct, and two layers of, protection against back-flow of water from lower batt layer 24 toward upper batt layer 22.

Figure 12:
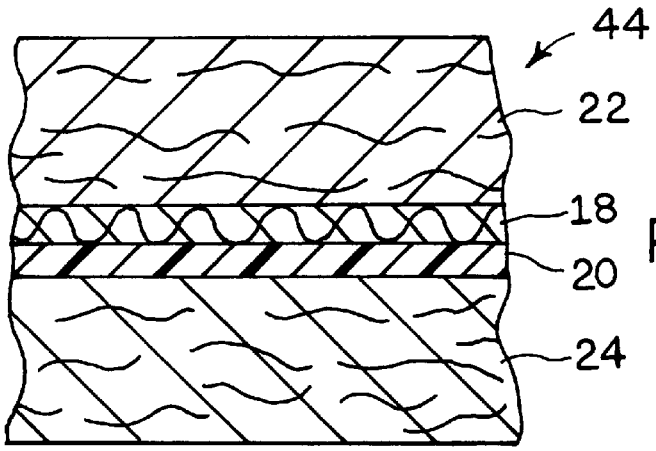
FIG. 12 shows a cross-section similar to that of FIG. 8, illustrating a seventh structure for papermaking felts of the invention wherein the base fabric is disposed between the outer batt layer and a single flow control layer.

FIG. 12 illustrates a felt 44 constructed according to the invention. Like reference characters are used to facilitate clarity. Felt 44 includes upper batt layer 22, flow control layer 20, lower batt layer 24, and base fabric 18. These layers are in the same position as in felt 42 of FIG. 11. Referring to felt 42 of FIG. 11, felt 44 omits the second flow control layer 20'.

Figure 13:
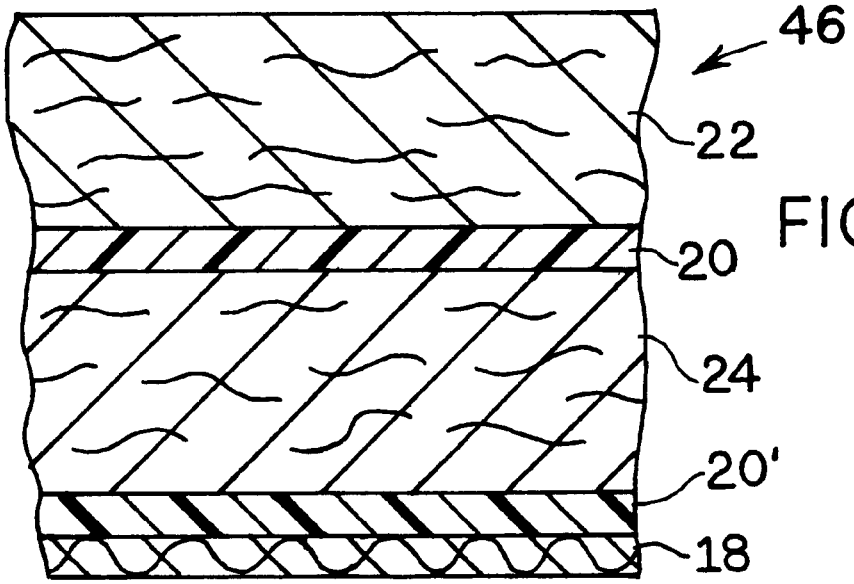
FIG. 13 shows a cross-section similar to that of FIG. 7, illustrating an eighth structure for papermaking felts of the invention wherein a second flow control layer is disposed between the base fabric and an interior batt layer.

FIG. 13 illustrates a felt 46 constructed according to the invention. Like reference characters are used to facilitate clarity. Felt 46 includes upper batt layer 22, flow control layer 20, lower batt layer 24 and base fabric 18. These layers are in the same relative positions as in felt 34 of FIG. 7. Felt 46 further incorporates a second flow control layer 20' between base fabric 18 and lower batt layer 24.

Felts 34, 36, 38, 40, 42, 44, and 46 are constructed in the same manner as described above with respect to felt 14, namely by needling operations in which various layers of the respective felts are needled together to make the respective felts. Those skilled in the art know that various needling operations can advantageously be used in fabricating papermaking felts. The number and type of needling operations used for fabricating felts of the invention can be selected according to such known felt fabrication processes.

In some embodiments utilizing second flow control layer 20', the second flow control layer is made according to specifications differing from the specifications used to make the respective first flow control layer 20. The second flow control layer may differ from the first flow control layer, for example, in such areas as filament cross-section, chemical treatment, basis weight, forming method, and the like. Referring especially to felt structures wherein second flow control layer 201 is disposed in surface-to-surface contact with first flow control layer 20, and wherein first flow control layer 20 is between second flow control layer 20' and base fabric 18, the second flow control layer may be less hydrophobic than the first flow control layer such that, when pressure on the respective felt, and on fibrous material 16, is relieved, any water in the two flow control layers is relatively urged, by hydrophobic forces within the two flow control layers, toward the second flow control layer and thus away from upper batt layer 22.

In any of the flow control layers of the invention, whether layer 20 or layer 20', the (e.g. spunbonded) filaments making up the respective flow control layer may have any of the filament cross-sections described herein. Further, within any one flow control layer, a variety of filament cross-sections may be used. For example, all the filaments may have the same or similar cross sections. Ten weight percent of the filaments may have a first cross-section (e.g. tri-lobed) while 90 weight percent of the filaments have a second cross-section (e.g. circular). Similarly, 30 weight percent of the filaments may have a first cross-section (e.g. tri-lobed) while 70 weight percent of the filaments have a second cross-section (e.g. circular). Further, the relative ratios of the amounts of the filaments having the first and second cross-sections may be any desired ratio such as 50 weight percent for each of the first and second cross-sections, 75 weight percent for the first cross-section and 25 percent for the second cross-section, 90 percent for the first cross-section and 10 percent for the second cross-section. Similarly, more than two filaments, having a corresponding number of different cross-sections, may be used in a single flow control layer.

While the cross-sections have been illustrated as circular (FIG. 5) and tri-lobed/triangular (FIG. 6), the cross-section of any of the filaments may have any desired shape. In addition to the illustrated circular and triangular shapes, the cross-section may be, for example, rectangular including square, ovoid, may have straight, concave or convex sides, may have more than four sides, etc.

Since the industry recognizes that each felt is designed for a specific papermaking machine running a known set of papermaking conditions in a known operating environment, those skilled in the art recognize that no one set of filament cross-sections and the like can be applied to all papermaking machines. Rather, the skilled artisan selects the preferred specification for the flow control layer or layers based on routine testing.

The felts, including flow control layers, disclosed herein are suitable for use on papermaking machines processing a wide variety of paper webs, including webs incorporating synthetic and other long fibers in the respective paper furnishes.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A felt for use in dewatering fibrous material in a papermaking machine, said felt comprising:

(a) a base fabric;

(b) a fibrous batt layer having opposing first and second surfaces on respective first and second sides of said fibrous batt layer, the first surface being disposed toward the fibrous material; and (c) a porous hydrophobic flow control layer of filaments on the second side of said fibrous batt layer, at least 10 percent by weight of said filaments in said flow control layer being non-circular filaments and thus, in cross-section, representing substantially non-circular perimeters, said base fabric, said fibrous batt layer, and said flow control layer being joined together into said felt.

2. A felt as in claim 1 wherein water under pressure from a press nip in the papermaking machine is forced from said fibrous batt layer through said flow control layer, said flow control layer functioning to impede backflow of water into said fibrous batt layer as pressure on said felt is relieved.

3. A felt as in claim 1, at least 30 percent by weight of said filaments in said flow control layer being said non-circular filaments.

4. A felt as in claim 1, at least 50 percent by weight of said filaments in said flow control layer being said non-circular filaments.

5. A felt as in claim 1, at least 75 percent by weight of said filaments in said flow control layer being said non-circular filaments.

6. A felt as in claim 1, at least 90 percent by weight of said filaments in said flow control layer being said non-circular filaments.

7. A felt as in claim 1, substantially all of said filaments in said flow control layer being said non-circular filaments.

8. A felt as in claim 1, said non-circular filaments comprising filaments having substantially flat surfaces thereon.

9. A felt as in claim 4, said non-circular filaments comprising filaments having substantially flat surfaces thereon.

10. A felt as in claim 6, said non-circular filaments comprising filaments having substantially flat surfaces thereon.

11. A felt as in claim 7, said non-circular filaments comprising filaments having substantially flat surfaces thereon.

12. A felt as in claim 1, said non-circular filaments comprising tri-lobed filaments.

13. A felt as in claim 4, said non-circular filaments comprising tri-lobed filaments.

14. A felt as in claim 5, said non-circular filaments comprising tri-lobed filaments.

15. A felt as in claim 6, said non-circular filaments comprising tri-lobed filaments.

16. A felt as in claim 1, said non-circular filaments having weights of about 4 denier to about 6 denier.

17. A felt as in claim 1, said non-circular filaments comprising four-lobed filaments.

18. A felt as in claim 1, said flow control layer comprising a layer of spunbonded material, including said filaments.

19. A felt for use in dewatering fibrous material in a papermaking machine, said felt comprising:

(a) a fibrous batt layer having opposing first and second surfaces on respective first and second sides of said fibrous batt layer, the first surface being disposed toward the fibrous material;

(b) a base fabric having a third surface disposed toward said fibrous batt layer, and an opposing fourth surface;

(c) a first porous hydrophobic flow control layer of synthetic filaments between said fibrous batt layer and said base fabric; and (d) a second porous hydrophobic flow control layer of synthetic filaments between said fibrous batt layer and said base fabric, said fibrous batt layer, said base fabric, and said first and second flow control layers being joined together in said felt, water under pressure from a press nip processing the fibrous material on said felt being forced from said fibrous batt layer through said first and second flow control layers, said first and second flow control layers functioning to impede backflow of water into said fibrous batt layer as nip pressure on said felt is relieved.

20. A felt as in claim 19, said first and second flow control layers being in surface-to-surface contact with each other.

21. A felt as in claim 19, at least 10 percent by weight of said filaments in said first flow control layer being non-circular filaments and thus, in cross-section, representing substantially non-circular perimeters.

22. A felt as in claim 19, filaments in said first flow control layer being circular filaments and thus, in cross-section, representing substantially circular perimeters, at least 10 percent by weight of said filaments in said second flow control layer being non-circular filaments and thus, in cross-section, representing non-circular perimeters.

23. A felt as in claim 22, said first flow control layer being between said fibrous batt and said second flow control layer.

24. A felt as in claim 22, said second flow control layer being between said fibrous batt and said first flow control layer.

25. A felt as in claim 19, said fibrous batt layer comprising a first fibrous batt layer, and including a second fibrous batt layer between said first and second flow control layers.

26. A felt as in claim 25, said first fibrous batt layer having a first density, said second fibrous batt layer having a second density greater than the first density.

27. A felt as in claim 21, said non-circular filaments comprising filaments having substantially flat surfaces thereon.

28. A felt as in claim 21, said non-circular filaments comprising tri-lobed filaments.

29. A felt as in claim 23, said non-circular filaments comprising tri-lobed filaments.

30. A felt as in claim 19, at least 30 percent by weight of said filaments in said first flow control layer being non-circular filaments and thus, in cross-section, representing substantially non-circular perimeters.

31. A felt as in claim 19, at least 10 percent by weight of said filaments in said first flow control layer comprising tri-lobed filaments.

32. A felt as in claim 19, at least 30 percent by weight of said filaments in said first flow control layer comprising tri-lobed filaments.

33. A felt as in claim 19, at least 50 percent by weight of said filaments in said first flow control layer comprising tri-lobed filaments.

34. A felt as in claim 19, at least 75 percent by weight of said filaments in said first flow control layer comprising tri-lobed filaments.

35. A felt as in claim 19, at least 90 percent by weight of said filaments in said first flow control layer comprising tri-lobed filaments.

36. A felt as in claim 21, said non-circular filaments comprising four-lobed filaments.

37. A felt for use in dewatering fibrous material in a papermaking machine, said felt comprising:

(a) a fibrous batt layer having opposing first and second surfaces on respective first and second sides of said fibrous batt layer, the first surface being disposed toward the fibrous material;

(b) a base fabric having a third surface on a third side thereof, disposed toward said fibrous batt layer, and a fourth opposing surface disposed away from said fibrous batt layer; and (c) a porous hydrophobic flow control layer of synthetic filaments, said base fabric being between said fibrous batt layer and said flow control layer, said felt having no layer, between said base fabric and said fibrous batt layer, corresponding to said flow control layer.

38. A felt as in claim 37, said flow control layer comprising a first flow control layer, and including a second porous flow control layer of synthetic filaments on a surface of said first flow control layer disposed away from said base fabric.

39. A felt as in claim 38, said second flow control layer being less hydrophobic than said first flow control layer such that any water in said first flow control layer tends to migrate toward said second flow control layer when pressure on said felt and the fibrous material is relieved.

40. A felt as in claim 38, said first and second flow control layers being in surface-to-surface contact with each other.

41. A felt as in claim 38, at least 10 percent by weight of said filaments in at least one of said first and second flow control layers being non-circular filaments and thus, in cross-section, representing substantially non-circular perimeters.

42. A felt as in claim 41, said non-circular filaments comprising filaments having substantially flat surfaces thereon.

43. A felt as in claim 38, at least 30 percent by weight of said filaments in one of said first and second flow control layers being non-circular filaments and thus, in cross-section, representing substantially non-circular perimeters.

44. A felt as in claim 37, at least 10 percent by weight of said filaments in said flow control layer comprising tri-lobed filaments.

45. A felt as in claim 37, at least 30 percent by weight of said filaments in said flow control layer comprising tri-lobed filaments.

46. A felt as in claim 37, at least 50 percent by weight of said filaments in said flow control layer comprising tri-lobed filaments.

47. A felt as in claim 37, at least 75 percent by weight of said filaments in said flow control layer comprising tri-lobed filaments.

48. A felt as in claim 37, at least 90 percent by weight of said filaments in said flow control layer comprising tri-lobed filaments.

49. A felt as in claim 41, said non-circular filaments comprising four-lobed filaments.

* * * * *